US006995734B2

(12) United States Patent
Moon

(10) Patent No.: US 6,995,734 B2
(45) Date of Patent: Feb. 7, 2006

(54) APPARATUS FOR DRIVING METAL INSULATOR METAL FIELD EMISSION DISPLAY DEVICE AND METHOD FOR SAME

(75) Inventor: Seong Hak Moon, Yongin (KR)

(73) Assignee: LG Electronics Inc., Seoul (KR)

( * ) Notice: Subject to any disclaimer, the term of this patent is extended or adjusted under 35 U.S.C. 154(b) by 325 days.

(21) Appl. No.: 10/201,786

(22) Filed: Jul. 25, 2002

(65) Prior Publication Data

US 2003/0030600 A1 Feb. 13, 2003

(30) Foreign Application Priority Data

Aug. 13, 2001 (KR) ..... 2001-48770

(51) Int. Cl.
*G09G 3/20* (2006.01)

(52) U.S. Cl. ..... 345/55; 345/59

(58) Field of Classification Search ..... 345/55, 345/204, 100, 74.1, 75.1, 206, 74–75.2, 84, 345/72, 108, 208, 211, 86–89, 59; 315/169.1, 315/169.3; 313/292, 495, 512; 378/119; 382/294

See application file for complete search history.

(56) References Cited

U.S. PATENT DOCUMENTS

| | | | | |
|---|---|---|---|---|
| 5,148,461 | A * | 9/1992 | Shoulders | 378/119 |
| 5,631,666 | A * | 5/1997 | Tagawa et al. | 345/104 |
| 6,140,985 | A * | 10/2000 | Kanai et al. | 345/74.1 |
| 6,246,178 | B1 * | 6/2001 | Isono | 315/169.3 |
| 6,356,254 | B1 * | 3/2002 | Kimura | 345/108 |
| 6,360,027 | B1 * | 3/2002 | Hossack et al. | 382/294 |
| 6,377,252 | B2 * | 4/2002 | Ikeda | 345/211 |
| 6,445,367 | B1 * | 9/2002 | Suzuki et al. | 345/75.2 |
| 6,600,263 | B1 * | 7/2003 | Ito | 313/495 |
| 6,703,792 | B2 * | 3/2004 | Kawada et al. | 315/169.4 |
| 6,882,330 | B2 * | 4/2005 | Moon | 345/75.2 |
| 2001/0033278 | A1 * | 10/2001 | Ohta et al. | 345/204 |
| 2002/0154101 | A1 * | 10/2002 | Abe et al. | 345/204 |
| 2003/0231156 | A1 * | 12/2003 | Takeuchi et al. | 345/98 |
| 2004/0041507 | A1 * | 3/2004 | Ito | 313/292 |
| 2004/0066363 | A1 * | 4/2004 | Yamano et al. | 345/98 |
| 2004/0155839 | A1 * | 8/2004 | Moon | 345/75.2 |
| 2004/0246245 | A1 * | 12/2004 | Yanagi et al. | 345/204 |
| 2005/0017991 | A1 * | 1/2005 | Yamazaki et al. | 345/690 |

* cited by examiner

*Primary Examiner*—Vijay Shankar
*Assistant Examiner*—Prabodh Dharia
(74) *Attorney, Agent, or Firm*—Fleshner & Kim, LLP

(57) ABSTRACT

An apparatus/method for driving a metal insulator metal device, which are capable of removing an electric charge in a pixel cell inside a panel. The apparatus includes a data supply unit which supplies video data to a plurality of data lines, a scan driving unit for sequentially supplying a scan pulse synchronized with the video data to at least one scan line among the plurality of scan lines which cross the data lines, and a switching unit for controlling an output impedance of the scan driving unit.

4 Claims, 6 Drawing Sheets

APPARATUS FOR DRIVING METAL INSULATOR METAL FIELD EMISSION DISPLAY DEVICE AND METHOD FOR SAME

BACKGROUND OF THE INVENTION

1. Field of the Invention

The present invention relates to a metal insulator metal field emission display device and particularly, to an apparatus and method for driving a metal insulator metal device which are capable of removing electric charge charged in the pixel cell inside a panel.

2. Description of the Background Art

Recently, various metal insulator metal (hereinafter, as MIM) display devices which can reduce weight and volume of a Cathode Ray Tube (hereinafter, as CRT) have been developed. The metal insulator metal display device is divided to a Liquid Crystal Display (hereinafter, as LCD), Field Emission Display (hereinafter, as FED), Plasma Display Panel, Electro-Luminescence (hereinafter, as EL) and the like. To improve the displaying quality of the metal insulator metal display device, researches for increasing luminescence, contrast and colorimetric purity are actively in progress.

The FED is divided into a tip type FED which emits electron using the tunnel effect by concentrating a high electric field in the acute emitter, and a MIM FED which emits electron by concentrating a high electric field in a metal having a predetermined area.

FIG. 1 is a cross-sectional view showing a pixel cell of a MIM FED display device in accordance with the conventional art.

As shown in FIG. 1, the pixel cell of the MIM FED includes an upper glass substrate 2 which is laminated on an upper portion of an anode electrode 6, fluorescent material 12 which is deposited in a predetermined portion of the lower portion of the anode electrode 6, and a field emission array 16 which is formed on a lower substrate 4. The field emission array 16 includes a scan electrode 10 which is formed on the lower substrate 4, an insulation layer 14 which is formed on the scan electrode 4, and a data electrode 8 which is formed on the insulation layer 14. Hereinafter, the operation of the MIM FED will be described as follows.

First, the scan electrode 10 supplies a current to the insulation layer 14, the insulation layer 14 insulates between the scan electrode 10 and data electrode 8, and the data electrode 8 is used as a fetching electrode for fetching electrons. Also, the scan electrode 10 receives a scan pulse from the scan driving unit (not shown) and the data electrode 8 receives a data pulse from the data driving unit (not shown).

To display an image on the display device, firstly, a voltage of a positive polarity (plus+) is applied to the anode electrode 6 on the upper substrate 2. At this time, a voltage of a negative polarity (minus−) is received in the scan electrode 10 on the lower substrate 4 and a voltage of the positive polarity (plus+) is applied to the data electrode 8. That is, part of the electrons tunnels the insulation layer 14 and electrons having a high level of energy among the above electrons pass through the insulation layer 14 and data electrode 8 and is emitted to a vacuum space. The emitted electrons are bumped into the red, green and blue fluorescent material 12 and excite the fluorescent material 12. At this time, a visible ray of a color among red, green and blue colors is emitted according to the fluorescent material 12.

FIG. 2 is a wave view showing a driving wave form which is supplied to the MIM FED display device in accordance with the conventional art.

As shown in FIG. 2, a scan pulse SP of a negative polarity (minus−) is sequentially supplied to the scan lines S1~Sm of the MIM FED display device in accordance with the conventional art and a data pulse DP of a positive polarity (plus+) which is synchronized with the scan pulse of the negative polarity (minus−) is sequentially supplied to the data lines D. In the pixel cell to which a scan pulse SP and data pulse DP are supplied, electrons are emitted by voltage difference of the scan pulse SP and data pulse DP. This will be described with reference to FIG. 3.

FIG. 3 is a circuit view equivalently showing the driving unit and discharging cell, for applying a driving wave form to the scan line which is shown in FIG. 2.

As shown in FIG. 3, the scan driving unit includes a scan pulse supply unit 20 for generating a scan pulse, a scan drive Integrated Circuit (hereinafter, as IC) 22 for supplying the scan pulse SP which is supplied from the scan pulse supply unit 20 to a scan line S1 among scan lines S1~Sm, and a resistor R which is installed between the IC 22 and ground voltage source (hereinafter, as GND).

The scan pulse supply unit 20 includes first and second switches SW1 and SW2 which are installed in parallel between the GND and scan drive IC 22, a third switch SW3 which is installed between the scan pulse voltage source Vs and scan drive IC 22, and a fourth switch SW4 which is installed between a reset pulse voltage source Vr and scan drive IC 22.

The first to fourth switches SW1~SW4 turns on/off in respond to a control signal which is supplied from the timing control unit (not shown). That is, the first switch SW1 and third switch SW3 respond to the control signal which is supplied from the timing control unit in turn and supplies a scan pulse SP to the corresponding scan lines S1~Sm. The second switch SW2 and fourth switch SW4 supplies a reset pulse RP to all scan lines S1~Sm by responding to the control signal which is supplied from the timing control unit.

The first switch SW1 raises the scan pulse SP of a negative polarity (minus−) into the GND and the third switch SW3 supplies a scan pulse SP of a negative polarity (minus−). Also, the second switch SW2 operates oppositely to the fourth switch SW4 and lowers the scan pulse SP to a negative polarity (minus−). The fourth switch SW4 supplies a reset pulse RP to all scan lines S1~Sm.

On the other hand, the resistor R is a resistance for reducing a peak current when a voltage is instantaneously applied to the scan drive IC 22 and is a resistance protection device.

Hereinafter, the operation of the driving unit will be described with reference to FIG. 2.

First, the scan pulse SP of a negative polarity (minus−) is supplied from the scan pulse voltage source Vs to the first scan line S1 through an internal diode of the scan drive IC 22, when the third switch SW3 and second switch SW2 are turned on under the condition that the first and fourth switches SW1 and SW4 are turned off. The data pulse DP is supplied to the data electrode D in synchronization with the scan pulse SP of a negative polarity (minus−).

When the first switch SW1 is turned on at the same time as the third switch SW3 is turned off, the first scan line S1 receives a zero potential (GND) by the first switch 58.

Then, second switch SW2 is turned off when the scan pulse SP is supplied to all scan lines S1~Sm, and on the other hand, the fourth switch SW4 is turned on, thus to supply the reset pulse RP of a positive polarity (plus+) from the reset pulse voltage source Vr.

By repeating such process, an image is displayed by driving a pixel cell by sequentially applying the scan pulse SP and data pulse DP to the mth scan line Sm. After displaying the image, the reset pulse of a positive polarity (plus+) is applied to the first to mth scan lines S1~Sm. That is, when the reset pulse RP is applied to the first to mth scan lines S1~Sm, electric charge which is charged in the pixel cell is removed.

The reset pulse RP is supplied from the reset pulse voltage source Vr to all scan electrodes S, when the fourth switch SW4 of the scan pulse supply unit is turned on. At this time, the reset pulse is flowed to the scan electrode S through the internal diode of the scan drive IC 22. An output impedance of the scan drive IC 22 is changed by the resistor R which is connected between the GND and output terminal of the scan drive IC 22. Also, as the number of the scan line increases, (namely, as resolution increases), the whole output impedance is also changed and the voltage of the reset pulse RP is decreased as the voltage for supplying the reset pulse by the output of the switching device and resistance of the output side. This will be described with reference to FIG. 4.

FIG. 4 is a wave view showing the conventional reset pulse that the amplitude change was occurred.

As shown in FIG. 4, the amplitude A of the reset pulse RP which is supplied to all scan electrodes S by the change of the output impedance of the scan drive IC 22 (the whole output impedance is changed according to increase/decrease of number of the scan lines) is decreased lower than the amplitude which is supplied from the reset pulse voltage source Vr. That is, since the amplitude A of the reset pulse RP is changed as the output impedance of the scan pulse supply unit 20 changes, the electric charge which is charged in the pixel cell could not be completely removed. Also, as the charge which is charged in the pixel cell could not be completely removed, current leakage which flows from the pixel cell to the GND through the resistor R was occurred, thus to decrease life span of the MIM FED.

As described above, in the MIM FED in accordance with the conventional art, the amplitude A of the reset pulse RP is changed as the output impedance of the scan pulse supply unit 20 changes and accordingly, the electric charge which is charged in the pixel cell could not be completely removed.

Also, in the MIM FED in accordance with the conventional art, the electric charge which is charged in the pixel cell could not be completely removed and accordingly, current leakage which flows from the pixel cell to the GND through the resistor R is occurred, thus to decrease the life span.

SUMMARY OF THE INVENTION

Therefore, an object of the present invention is to provide an apparatus for driving MIM device and method for the same, capable of completely removing electric charge which is charged in the pixel cell by regularly fixing the output impedance of the scan driving unit regardless of resolution of the scan line.

To achieve these and other advantages and in accordance with the object of the present invention, as embodied and broadly described herein, there is provided an apparatus for driving MIM device, including a data supply unit which supplies video data to a plurality of data lines, a scan driving unit for sequentially supplying the scan pulse which is synchronized with the video data to at least one scan line among the plurality of scan lines which cross the data lines, and a switching unit for controlling the output impedance of the scan driving unit.

To achieve these and other advantages and in accordance with the purpose of the present invention, as embodied and broadly described herein, there is provided a method for driving MIM device, including the steps of supplying video data to the plurality of data lines, sequentially supplying the scan pulse which is synchronized with the video data to a scan line among the plurality of scan lines which cross the plurality of data lines, and supplying a reset pulse to the scan lines by fixing the output impedance of the scan driving IC which supplies the scan pulse to one of the scan lines regularly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, preferred embodiments of the apparatus for driving metal insulator metal device and method for the same, which are capable of completely removing electric charge which is charged in a pixel cell by regularly fixing output impedance of the scan driving unit will be described with reference to FIGS. 5 to 9.

Figure 1:
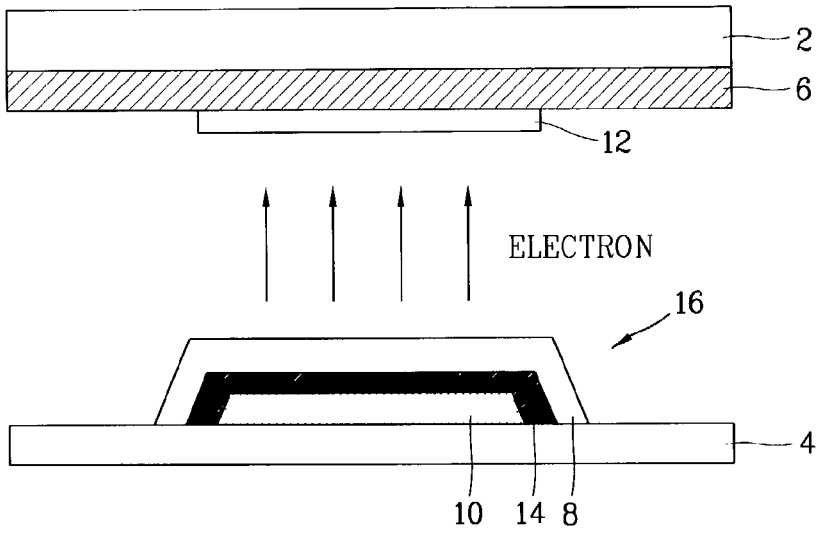
FIG. 1 CONVENTIONAL ART
FIG. 1 is a cross-sectional view showing a pixel cell of a metal insulator metal (hereinafter, as MIM) field emission display (FED) display device in accordance with the conventional art.
Figure 2:
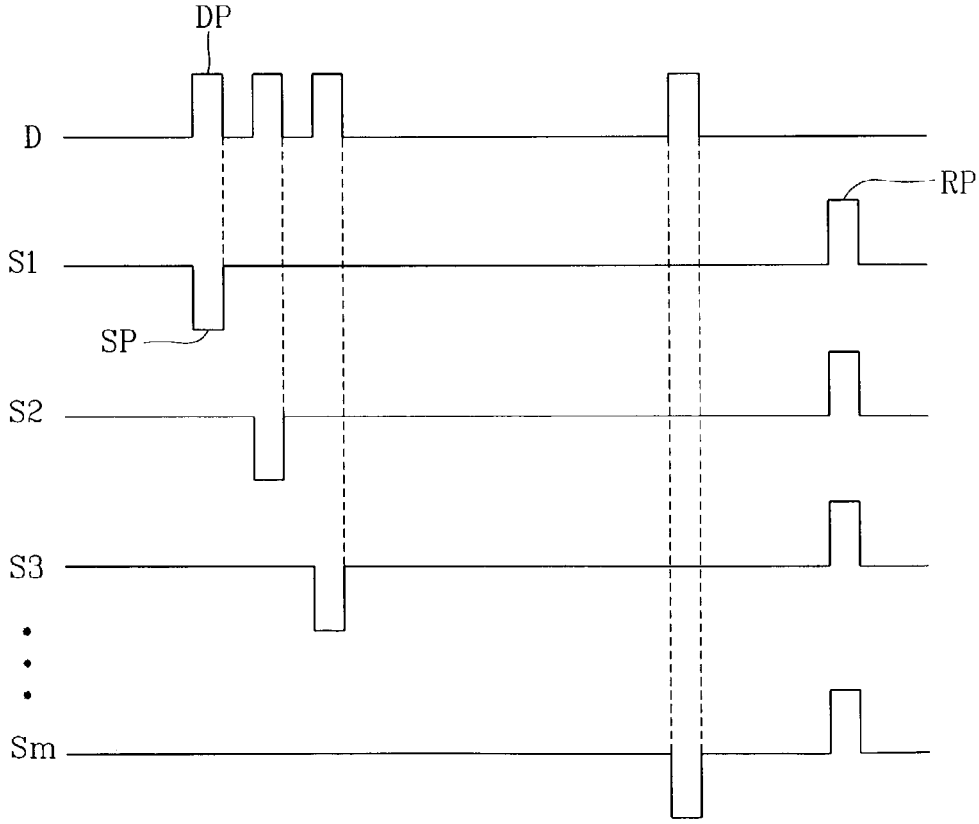
FIG. 2 CONVENTIONAL ART
FIG. 2 is a wave view showing a driving wave form which is supplied to the MIM FED display device in accordance with the conventional art.
Figure 3:
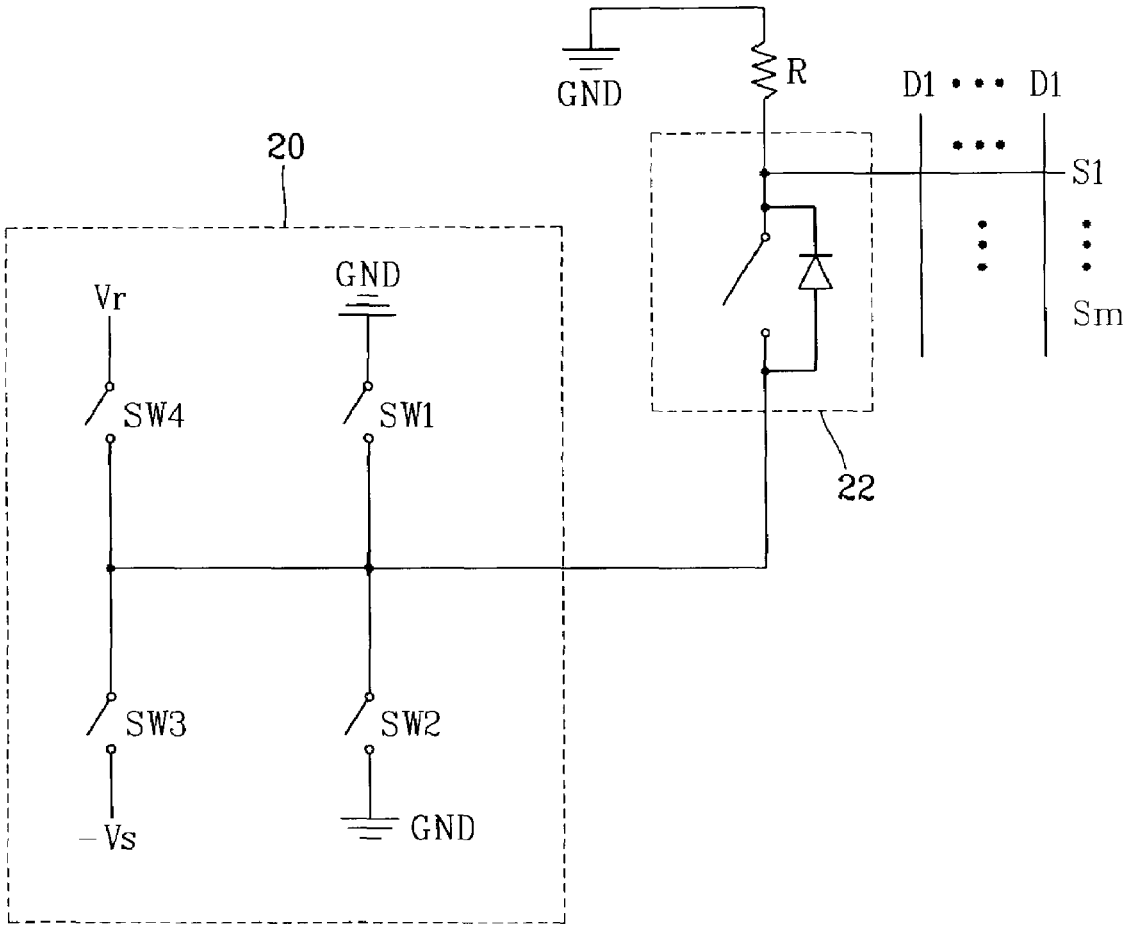
FIG. 3 CONVENTIONAL ART
FIG. 3 is a circuit view equivalently showing a driving unit and discharging cell, for applying a driving wave form to the scan line which is shown in FIG. 2.
Figure 4:
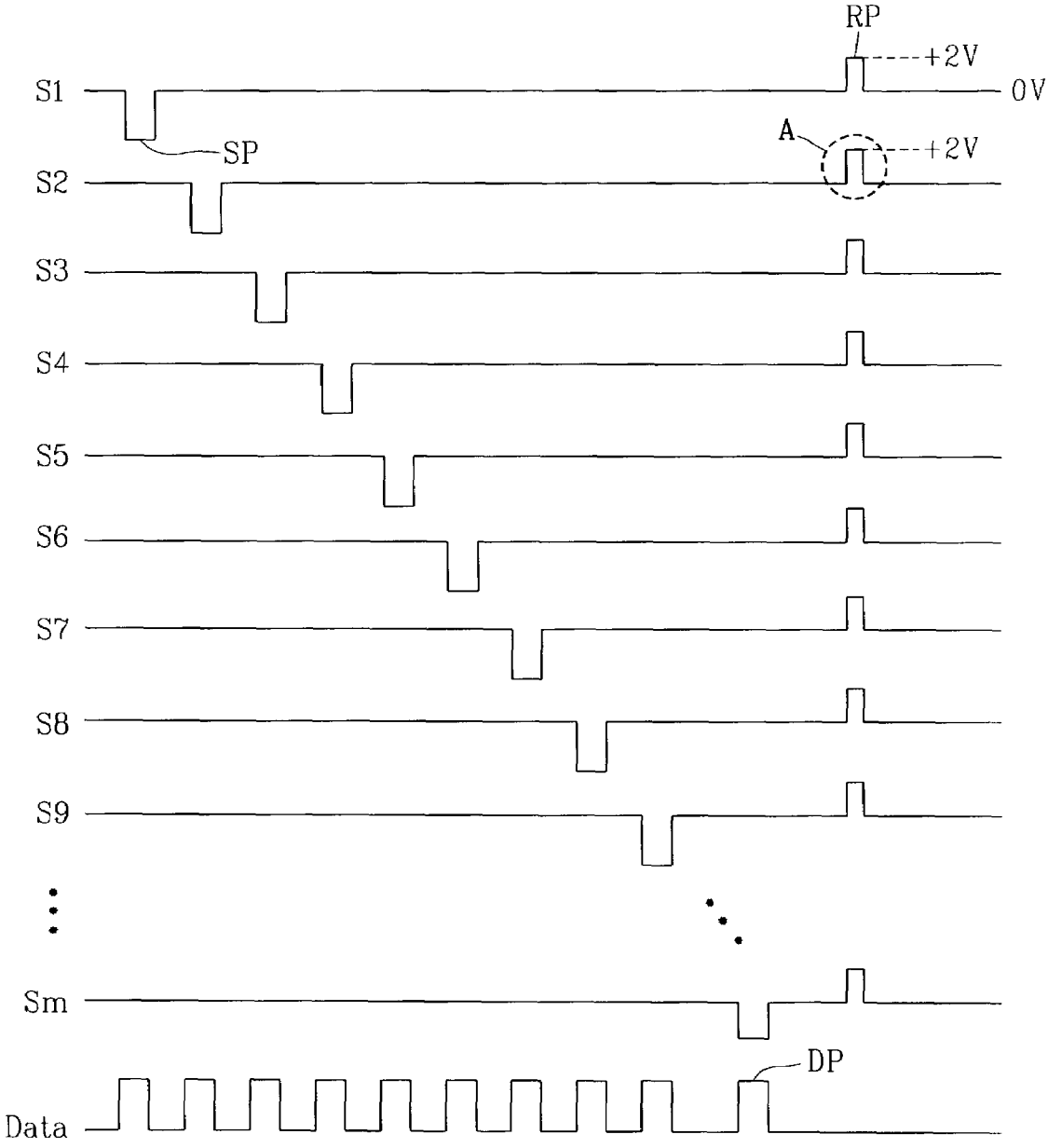
FIG. 4 CONVENTIONAL ART
FIG. 4 is a wave view showing a conventional reset pulse that an amplitude change was occurred.
Figure 5:
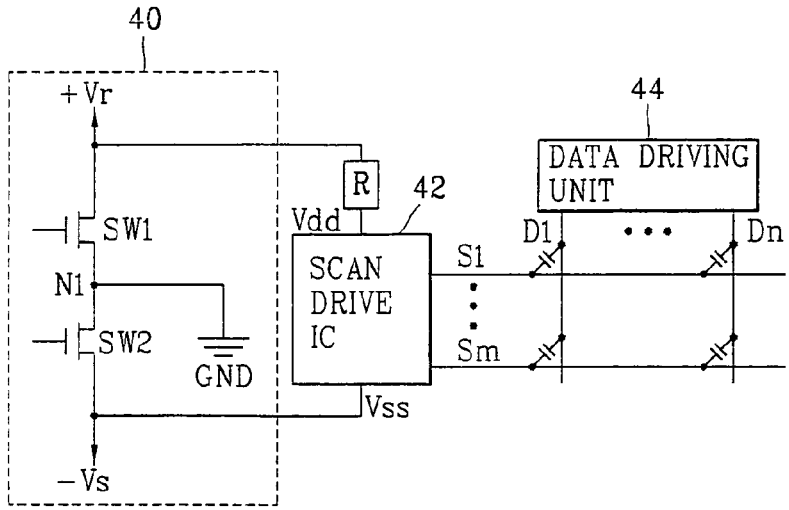
FIG. 5 is a view showing a driving unit of the MIM FED in accordance with the present invention.

FIG. 5 is a view showing a driving unit of the MIM FED in accordance with the present invention.

As shown in FIG. 5, the driving unit of the MIM FED in accordance with the present invention includes a data driving unit 44 for driving the data lines D1~Dn, a scan pulse supply unit 40 for generating a scan pulse, a scan drive IC (Integrated Circuit; IC) 42 for supplying the scan pulse SP which is supplied from the scan pulse supply unit 40 to a scan line S1 among scan lines S1~Sm, and a pull-up resistor R which is installed between the scan drive IC 42 and scan pulse supply unit 40. Hereinafter, the operation of the driving unit of the MIM FED in accordance with the present invention will be described as follows.

First, the data driving unit 44 receives video data and supplies a data pulse to the data lines D1~Dn.

The scan pulse supply unit 40 includes a switching unit which is composed of first and second switching devices SW1 and SW2 which are installed between the reset pulse voltage source +Vr and scan pulse voltage source Vs, for controlling the output impedance of the scan drive IC 42.

The first and second switching devices SW1 and SW2 are connected, positioning a GND therebetween. That is, the first switching device SW1 is connected to the reset pulse voltage source +Vr and the second switching device SW2 is connected to a scan pulse voltage source −Vs.

The output impedance of the scan drive IC 42 is composed of a plurality of switching devices in the open-drain shape. A pull-up resistor R is installed between all output terminals of the switching devices of the open-drain shape and reset pulse voltage source +Vr. Also, a ground terminal Vss of the scan drive IC 42 is connected to the scan pulse voltage source −Vs.

Figure 6:
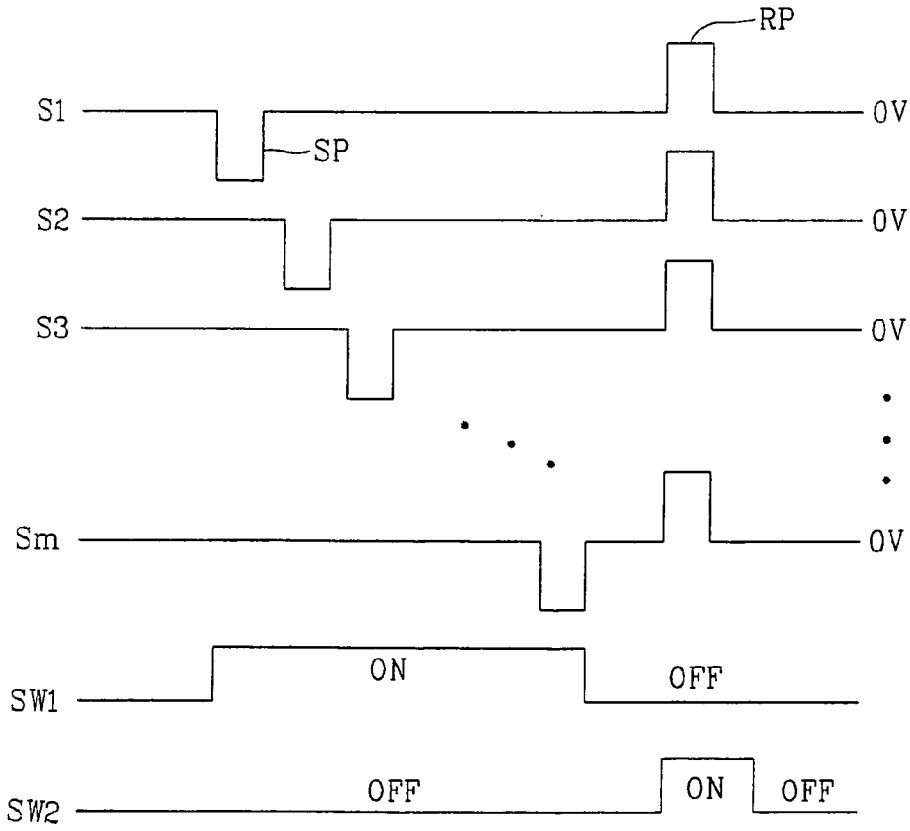
FIG. 6 is a wave view showing driving timing of a scan driving unit according to driving wave form of the MIM FED in accordance with a first embodiment of the present invention.

FIG. 6 is a wave view showing driving timing of the scan driving unit according to driving wave form of the MIM FED in accordance with a first embodiment of the present invention. This will be described with reference to FIGS. 5 and 7 in detail.

Figure 7:
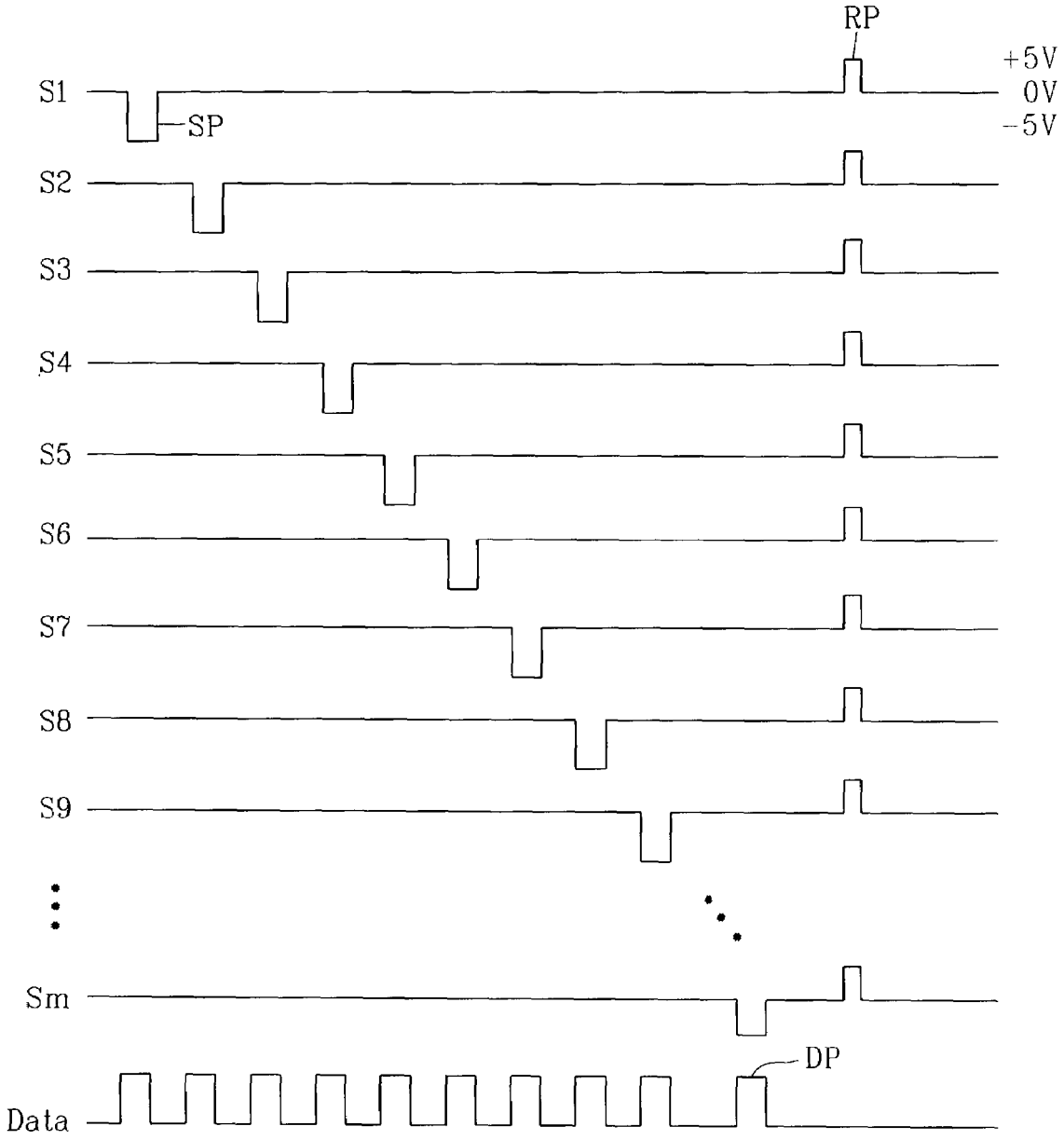
FIG. 7 is a wave view showing a driving wave form of the MIM FED in accordance with the first embodiment of the present invention.

FIG. 7 is a wave view showing the driving wave form of the MIM FED in accordance with the first embodiment of the present invention.

As shown in FIGS. 6 and 7, the scan driving unit turns on the first switching device SW1 and turns off the second switching device SW2, in case the scan pulse SP of the negative polarity (minus−) is supplied to the scan lines S1~Sm.

Also, in case a reset pulse RP of the positive polarity (+plus) is supplied to the scan lines S1~Sm, the first switching device SW1 is turned off and the second switching device SW2 is turned on. That is, since the scan pulse SP of the scan drive IC 42 must be outputted as a scan pulse (negative scan pulse) of the negative polarity (minus−) when the scan pulse SP is supplied to the scan lines S1~Sm, the first switching device SW1 is turned on and the second switching device SW2 is turned off. Then, the ground terminal of the scan drive IC 42 becomes a level of voltage of negative polarity and the power supply terminal Vdd of the scan drive IC 42 is connected to the GND through the pull-up resistor R and first switching device SW1. Accordingly, the scan pulse SP having a voltage of the negative polarity (minus−) is supplied to the scan line S from the scan pulse voltage source −Vs. At this time, the scan drive IC 42 sequentially supplies the scan pulse SP to all scan lines S1~Sm through the internal diodes (not shown) of a plurality of switching devices. At this time, the data driving unit 44 supplies the data pulse DP which is synchronized with the scan pulse SP of the negative polarity (minus−) to the data electrodes D1~Dn (data lines).

Then, when the scan pulse SP is supplied to all scan lines S1~Sm, the first switching device SW1 is turned off and the second switching device SW2 is turned on. Accordingly, the reset pulse (positive reset pulse) RP of the positive polarity (plus+) is supplied from the reset pulse voltage source +Vr to all scan lines S1~Sm. That is, when the second switching device SW2 is turned on, the level of the ground terminal Vss of the scan drive IC 42 becomes a ground level. Accordingly, the reset pulse RP of the positive polarity (plus+) which is supplied from the reset pulse voltage source +Vr is supplied to the scan drive IC 42 through the pull-up resistor R and then supplied to all scan lines S1~Sm by the switching operation of the scan drive IC 42.

Therefore, when the first and second switching devices SW1 and SW2 are turned on/off in turn and the reset pulse RP is supplied to the scan lines S1~Sm, the output impedance of the scan drive IC 42 is not changed by connecting the ground terminal Vss of the scan drive IC 42 to the GND. Accordingly, as shown in FIG. 7, the change of amplitude of the reset pulse RP can be minimized.

Figure 8:
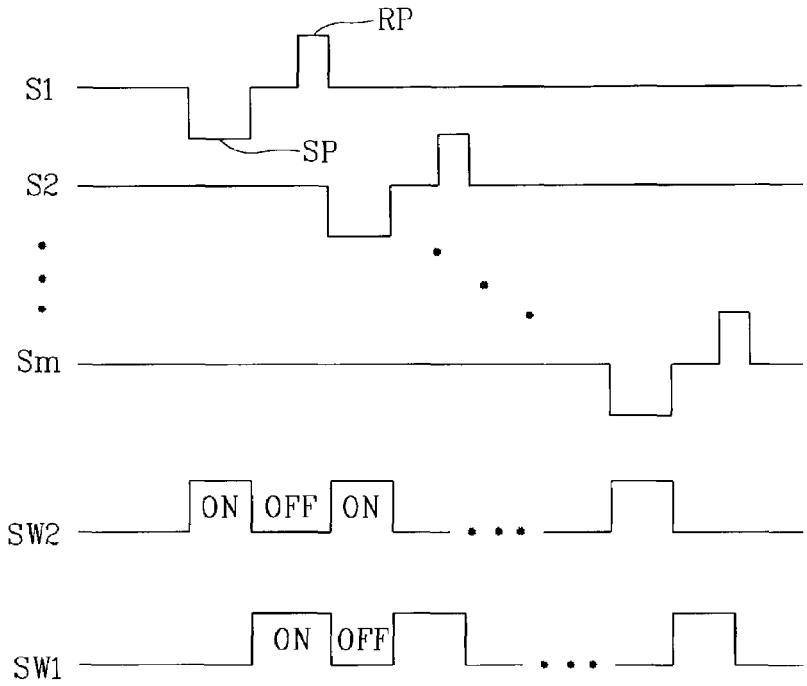
FIG. 8 is a wave view showing driving timing of the scan driving unit according to the driving wave form of the MIM FED in accordance with a second embodiment of the present invention.

FIG. 8 is a wave view showing driving timing of the scan driving unit according to the driving wave form of the MIM FED in accordance with a second embodiment of the present invention.

As shown in FIG. 8, the scan driving unit turns off the first switching device SW1 in case the scan pulse SP of the negative polarity (minus−) is supplied to the first scan line S1, and is driven by turning off the second switching device SW2. Then, the first switching device SW1 is turned off and the reset pulse RP of the positive polarity (plus+) is supplied to the first scan line S1 by turning on the second switching device SW2.

Also, the scan driving unit turns on the first switching device SW1 in case the scan pulse SP of the negative polarity (minus−) is supplied to the second scan line S2, and the first switching device SW1 is turned off by turning off the second switching device SW2. Then, the reset pulse RP of the positive polarity (plus+) is supplied to the second scan line S2 by turning on the second switching device SW2.

In case the scan pulse SP is supplied to the scan line S, only the first switching device SW1 is turned on and in case the reset pulse is supplied, only the second switching device SW2 is turned on. That is, the scan pulse SP and reset pulse RP are supplied in turn by turning on/off the first and second switching devices SW1 and SW2 in turn.

In detail, since the scan pulse SP of the scan drive IC 42 must be converted to a scan pulse of the negative polarity (minus−) and outputted when the scan pulse SP is supplied to the scan lines S1~Sm, the first switching device SW1 is turned on and if the second switching device SW2 is turned off, the level of the ground terminal Vss of the scan drive IC 42 becomes a negative voltage level. In addition, the power supply terminal Vdd is connected to the GND through the pull-up resistor R and first switching device SW. Accordingly, the scan pulse having a voltage of the negative polarity (minus−) which is supplied from the scan pulse voltage source −Vs, is supplied to the scan line S. At this time, the scan drive IC 42 supplies a scan pulse SP to the first scan line S1 through the internal diode (not shown). At this time, the data driving unit 44 supplies the data pulse DP which is synchronized with the scan pulse SP of the negative polarity (minus−) to the data lines D1~Dn.

Then, the first switching device SW1 is turned off, the second switching device SW2 is turned on and the reset pulse RP of the positive polarity (plus+) is supplied from the reset pulse voltage source +Vr to the first scan line S1. That is, as the ground terminal Vss of the scan drive IC 42 is connected to the GND, the reset pulse RP of the positive polarity (plus+) which is supplied from the reset pulse voltage source +Vr is supplied to the power supply terminal Vdd through the pull-up resistor R and then supplied to the first scan line S1 by the switching operation of the scan drive IC 42.

Figure 9:
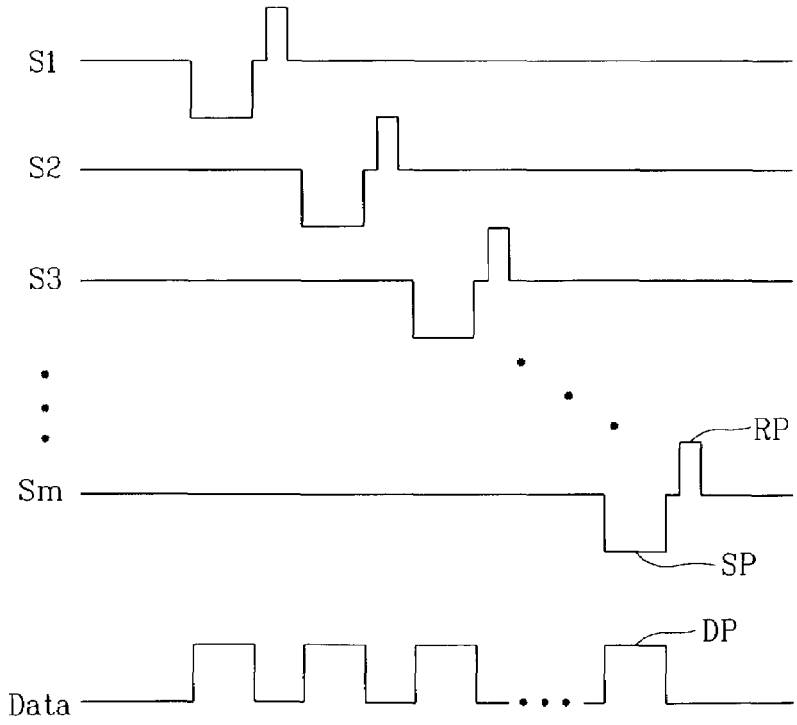
FIG. 9 is a wave view showing the driving wave form of the MIM FED in accordance with the second embodiment of the present invention.

FIG. 9 is a wave view showing the driving wave form of the MIM FED in accordance with the second embodiment of the present invention.

As shown in FIG. 9, the scan pulse SP is sequentially supplied to the scan lines S1~Sm and then the reset pulse RP is supplied. That is, when the reset pulse is supplied by turning on/off the first and second switching devices SW1 and SW2 in turn, the ground terminal Vss of the scan drive IC 42 is maintained as a ground level. That is, as shown in FIG. 7, change of the amplitude of the reset pulse RP can be minimized by fixing the output impedance of the scan drive IC 42 regularly by supplying a ground voltage to the ground terminal Vss of the scan drive IC 42. That is, the electric charge which is charged in the pixel cell can be completely removed by minimizing change of the amplitude of the reset pulse by fixing the output impedance of the scan drive IC 42 regularly. Therefore, when the output impedance of the scan drive IC 42 is changed, the reset pulse RP of the positive polarity (plus+) is supplied from the reset pulse voltage source to the scan lines S1~Sm as it is.

As described above, the apparatus for driving MIM device and method for the same in accordance with the present invention can completely remove the electric charge which is charged in the pixel cell, by regularly fixing the output impedance of the scan drive IC 42 using two switching devices.

Also, the apparatus for driving MIM device and method for the same can minimize life span decrease of the field emission display device by completely removing the electric charge charged in the pixel cell.

Also, the apparatus for driving MIM device and method for the same can have the scan driving unit become simpler and plainer, by regularly fixing the output impedance of the scan drive IC using two switching devices, thus to decrease price of the scan driving unit.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for driving a metal insulator metal device, fixing an output impedance of a scan driving IC (integrated circuits), which supplies a reset pulse to at least one scan line among a plurality of scan lines, to remove an electric charge in a pixel cell, by supplying ground voltage to a ground terminal of the scan drive IC when the reset pulse is applied to the at least one scan line and further comprising sequentially supplying a scan pulse to the at least one scan line; a first switch that is switched ON to supply the scan pulse; a second switch that is switched ON to supply the reset pulse; and a ground connected between the first switch and the second switch, wherein when the first switch is ON, the second switch is OFF, and vice versa.

2. The apparatus of claim 1, wherein when the first switch is ON and the second switch is OFF, a reset pulse voltage source for supplying the reset pulse is supplied to the ground, and a scan pulse voltage source for supplying the scan pulse is supplied to the scan driving unit.

3. The apparatus of claim 2, wherein when the first switch is OFF and the second switch is ON, the scan pulse voltage source is supplied to the ground such that the output impedance remains fixed, and the reset pulse voltage source is supplied to the scan driving unit.

4. The apparatus of claim 1, further comprising:

a data driving unit configured to supply data to a plurality of data lines crossing the plurality of scan lines.

* * * * *